US006921224B1

(12) United States Patent
Hsieh

(10) Patent No.: US 6,921,224 B1
(45) Date of Patent: Jul. 26, 2005

(54) RETRACTILE MECHANISM FOR REFILL OF WRITING INSTRUMENT

(76) Inventor: Ming-Jen Hsieh, No. 21, Sec. 3, Mu-Hsin Rd., Wen-Shan District, Taipei (TW)

( * ) Notice: Subject to any disclaimer, the term of this patent is extended or adjusted under 35 U.S.C. 154(b) by 0 days.

(21) Appl. No.: 11/002,086

(22) Filed: Dec. 3, 2004

(51) Int. Cl.[7] ..... B43K 5/16
(52) U.S. Cl. ..... 401/115; 401/113; 401/114
(58) Field of Search ..... 401/99, 109, 112, 401/113, 114, 115

(56) References Cited

U.S. PATENT DOCUMENTS 4,315,695 A * 2/1982 Alves dos Santos et al. . 401/99
4,461,590 A * 7/1984 Alves dos Santos et al. ..... 401/115
4,669,904 A * 6/1987 Kageyama et al. ..... 401/115

* cited by examiner

*Primary Examiner*—David J. Walczak
(74) *Attorney, Agent, or Firm*—Dennison, Schultz, Dougherty & MacDonald

(57) ABSTRACT

A retractile mechanism for refills of writing instrument includes an outer tube, a refill, an inner tube, a sliding ring with load and a compression spring. The inner tube having a front stopper on the front end and a rear stopper on the rear end thereof. By movement of the sliding ring and the elastic rear stopper, the inner tube and the refill are pushed forward and backward so as to manipulate the refills of the writing instrument.

5 Claims, 4 Drawing Sheets

RETRACTILE MECHANISM FOR REFILL OF WRITING INSTRUMENT

BACKGROUND OF THE INVENTION

The present invention relates to a retractile mechanism for refills of writing instrument, especially to a writing instrument having a refill extending out and being positioned for writing when the writing instrument is thrown forth; while the front end of the writing instrument is reversed upwards, the refill retracts, back to the storage status. Thus the refill of the writing instrument is retractable.

There are various kinds of mechanism for retracting or extending the refills of writing instruments. Generally, a button is pressed or released for manipulating the refill. Or The pen operates by adjusting the length of the penholder to extend or retract the refill, as an embodiment shown in U.S. Pat. No. 6,276,855 B1-"RETRACTILE PEN". However, the above-mentioned retractile mechanisms are out of date and lack of novelty. Thus there is a need to provide users a new writing instrument that retracts and extends the refill by a new designed mechanism.

SUMMARY OF THE INVENTION

Therefore it is a primary object of the present invention to provide a retractile mechanism for refills of writing instruments. The device is composed by a refill inserted inside an inner tube. Both the refill and the inner tube slide synchronously inside a penholder. A front stopper and a rear stopper are disposed on the front side and the rear side of the inner tube respectively. The rear stopper is an elastic claw-shaped stopper. A sliding ring with load encloses the inner tube and slides forward and backward freely. When the front end of the writing instrument is thrown forth, the sliding ring with load moves forwards by inertia, leans against the front stopper, and pushes the inner tube and refill moving forward synchronously. Thus the elastic rear stopper leaves the slot on the rear end of the outer tube and the claws on the rear part of the rear stopper extend outward for leaning against the projecting edge. The refill stands out the pen nib and is ready for writing. While the writing instrument is reversed with the front side upwards, the sliding ring slides down to the rear end of the inner tube by gravity and restrains the elastic rear stopper so as to make the elastic rear stopper leave the projecting edge and return back to the slot. And the refill as well as the inner tube retracts back to the storage status synchronously. Therefore, the operation for retracting or extending the refill of writing instruments is easy and convenient for users.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFFERED EMBODIMENT

Figure 1:
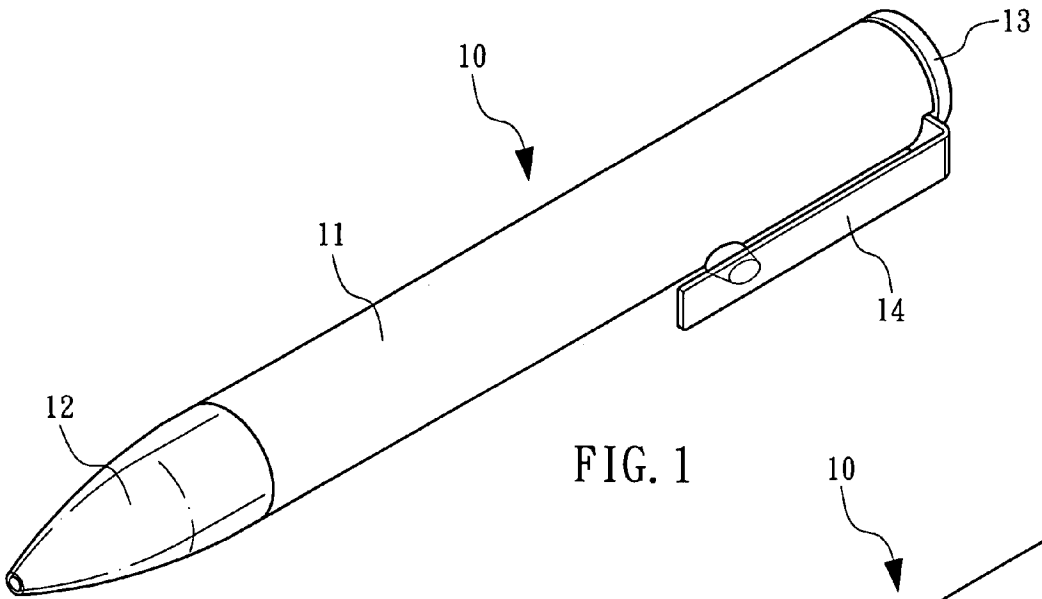
FIG. 1 is a perspective view of the present invention when the refill retracts.
Figure 2:
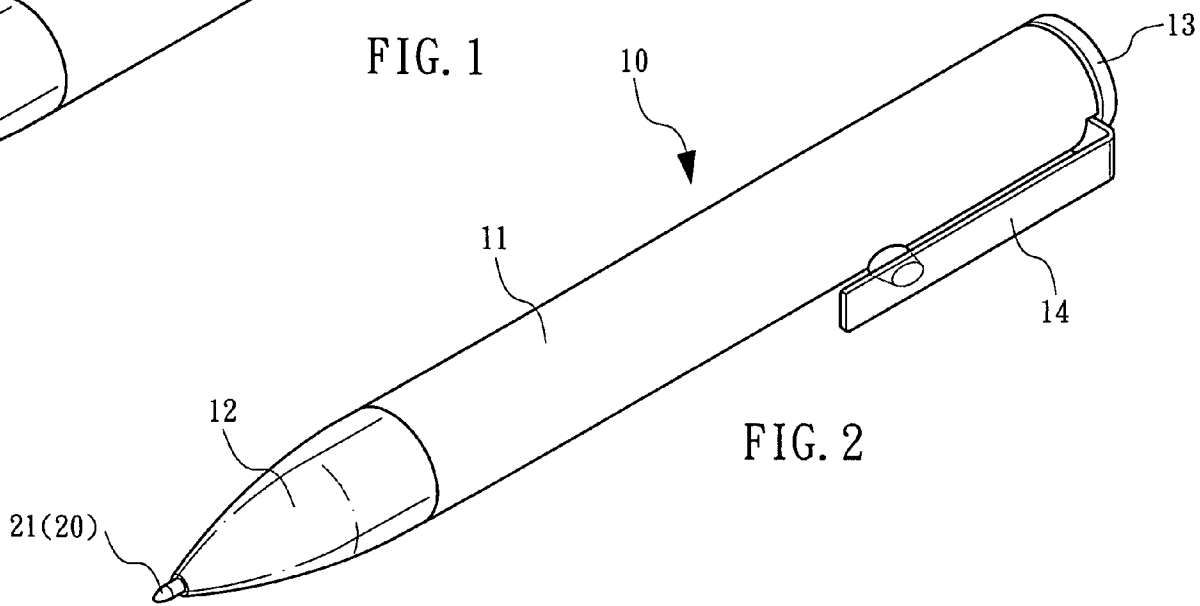
FIG. 2 is a perspective view of the present invention when the refill extends.
Figure 3:
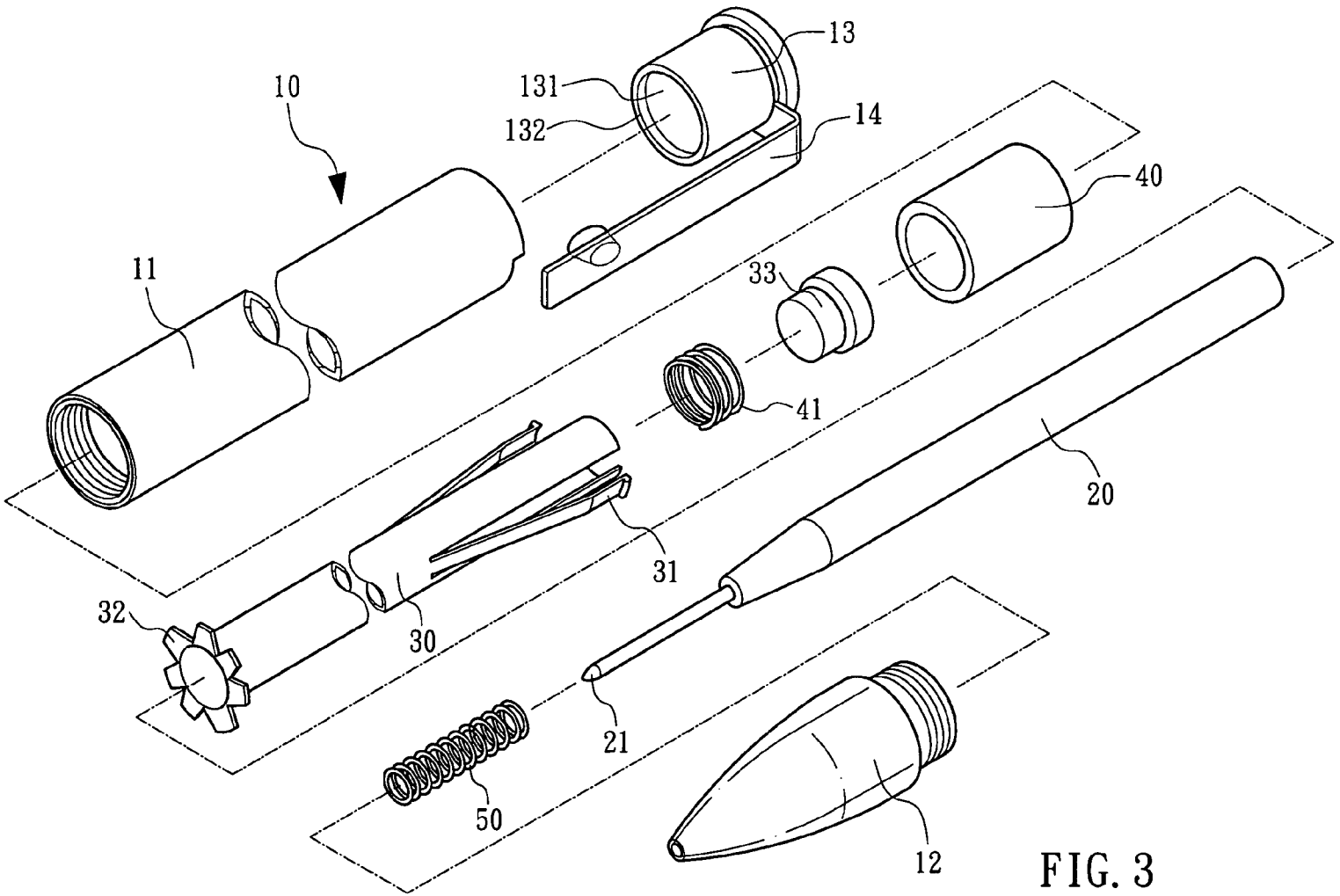
FIG. 3 is an explosive view of the present invention.

Refer from FIG. 1 to FIG. 3, the present invention includes an outer tube 10, a refill 20, an inner tube 30, a sliding ring 40, with load and a compression spring 50. The outer tube 10 is composed by a penholder 11, a pen nib 12, a tail 13 and a pen clip 14. A hollow slot 131 with certain depth is arranged in the center of the tail 13 while a projecting edge 132 is formed between the slot 131 and the tail 13.

The refill 20 is inserted into the inner tube 30 so that the refill 20 and the inner tube 30 move frontwards and backwards synchronously inside the outer tube 10.

A front stopper 32 is disposed on the front end of the inner tube 30 while an elastic claw-shaped rear stopper 31 extending outwards is installed on the rear end thereof. The diameter of the elastic claw-shaped rear stopper 31 in contraction status is a bit smaller than that of the slot 131 of the tail 13 thus the inner tube 30 can move in and out the slot 131 freely. A stop block 33 is arranged on the rear side of the inner tube 30 for against the refill 20. A compression spring 50 inside the pen nib 12 encloses the front end of the refill 20. Thus by the compression spring 50, the refill 20 is held between the pen nib 12 and the stop block 33 with the backward restoring force.

The sliding ring 40 is made of cupric or iron tube with certain load and is sleeved outside the inner tube 30, sliding between the front stopper 32 and the rear stopper 31. When the sliding ring 40 moves to the rear end of the inner tube 30, the elastic rear stopper 31 is astringed by the sliding ring 40. A buffering spring 41 is installed between the sliding ring 40 and the front stopper 32 for buffering.

Figure 5:
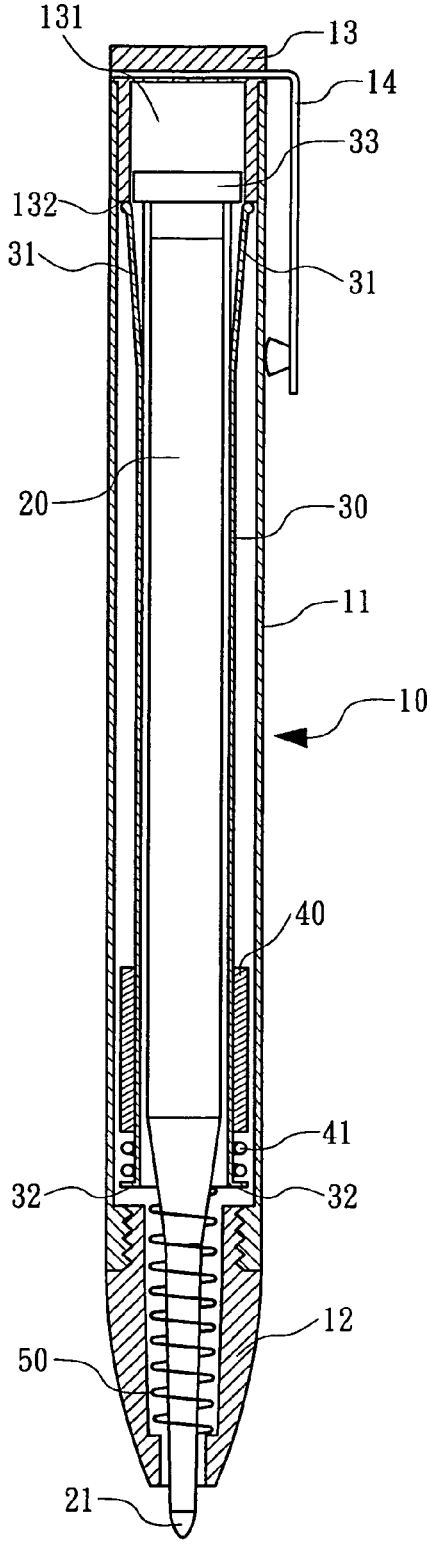
FIG. 5 is a cross-sectional view of the present invention when the refill extends.

The operation of the embodiment in accordance with the present invention is as following:

refer to FIG. 2 & FIG. 5, if users want to extend a nib point 21, the pen nib 12 is switched forwards. By the sliding ring 40 with load moves forwards by inertia, the inner tube 30 and the refill 20 are pushed forwards synchronously by the momentum of the sliding ring 40 when the sliding ring 40 contacts the front stopper 32 of the inner tube 30. At the same time, the elastic rear stopper 31 of the inner tube 30 also slides outside the slot 131. Without the restraint of the sliding ring 40, the claws of the elastic rear stopper 31 extends outward and against the projecting edge 132 on the opening of the slot 131 for positioning. Therefore, the inner tube 30 and the nib point 21 wont' retract backwards and are ready for writing.

Figure 4:
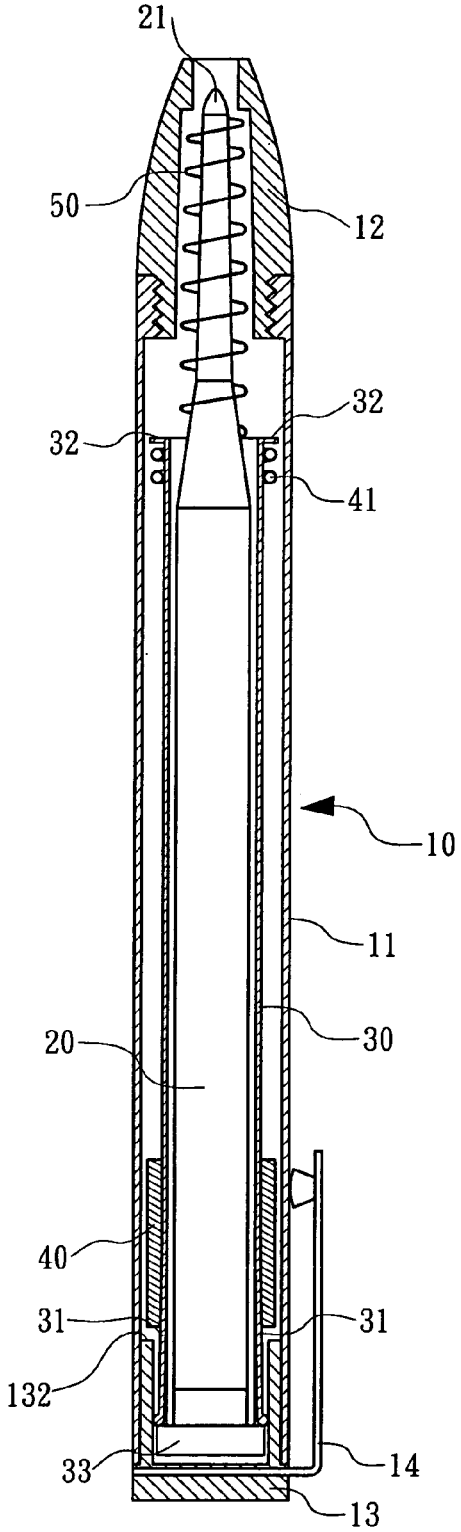
FIG. 4 is a cross-sectional view of the present invention when the refill retracts.

Refer to FIG. 1 & FIG. 4, if the users want to retract the nib point 21, the pen nib 12 is reversed with the front end upwards so that the sliding ring 40 with load slides downwards due to gravity. When the sliding ring 40 slides into the rear end of the inner tube 30, the elastic claw-shaped rear stopper 31 is restrained and contracted so that the elastic rear stopper 31 leaves the projecting edge 132 and slides into the slot 131 by gravity. Thus the inner tube 30 and the extended nib point 21 retract synchronously and back to the storage status.

Figure 6:
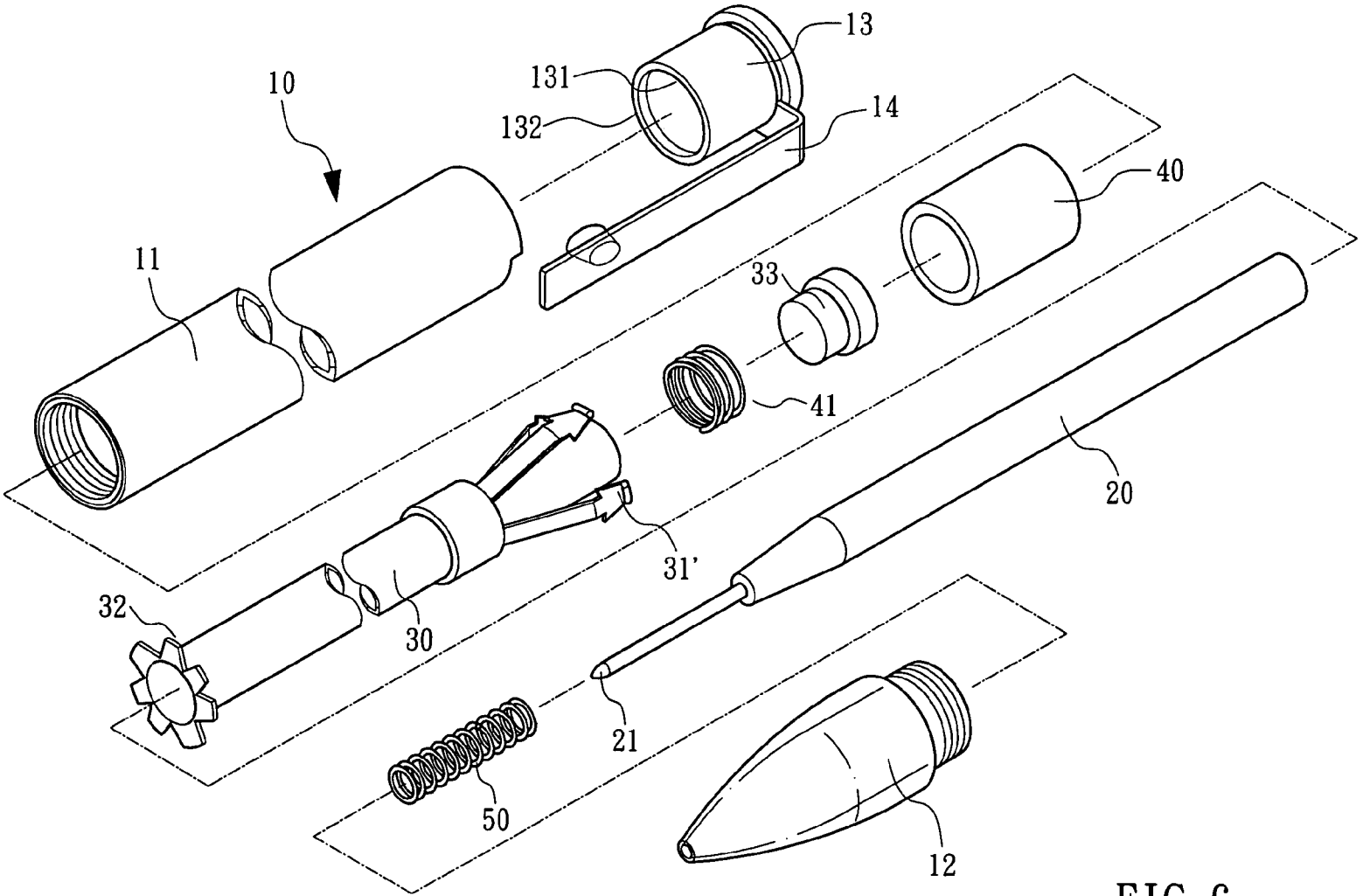
FIG. 6 is an explosive view of a further embodiment of the present invention.

As shown in FIG. 3, the elastic claw-shaped stopper 31 is integrated into the rear end of the inner tube 30 and forms one part. Refer to FIG. 6, the elastic claw-shaped stopper 31' is made independently and then is inserted on the rear end of the inner tube 30. Both the elastic claw-shaped stoppers 31, 31' have the same function as a rear stopper.

What is claimed is:

1. A retractile mechanism for refills of writing instrument comprising an outer tube, a refill, an inner tube, a sliding ring with load and a compression spring wherein the outer tube having a penholder, a pen nib, a tail and a pen clip while a hollow slot with certain depth is arranged in the center of the tail, and a projecting edge on the opening of the slot is formed between the slot and the tail;

the refill is inserted inside the inner tube and both the refill as well as the inner tube move synchronously so as to make the refill extend out the pen nib;

the inner tube is disposed inside the outer tube and moves forward and backward freely, with a front stopper mounted on the front end thereof and an elastic claw-shaped rear stopper arranged on the rear end thereof; the diameter of the elastic claw-shaped rear stopper in contraction status is a bit smaller than the diameter of the slot of the tail so that the inner tube moves in the slot freely;

the compression spring disposed inside the pen nib encloses the front end of the refill so as to hold the refill between the pen nib and a stop block of the inner tube;

the sliding ring is a ring with load, enclosing the inner tube and moving freely between the front stopper and the rear stopper; when the sliding ring reaches the rear end of the inner tube, the sliding ring restrains the elastic rear stopper into the contraction status.

2. The retractile mechanism for refills of writing instrument as claimed in claim 1, wherein a buffering spring is installed between the sliding ring and the front stopper for buffering.

3. The retractile mechanism for refills of writing instrument as claimed in claim 1, wherein the elastic rear stopper is integrated into the inner tube.

4. The retractile mechanism for refills of writing instrument as claimed in claim 1, wherein the elastic rear stopper is made independently and then is inserted on the rear end of the inner tube.

5. The retractile mechanism for refills of writing instrument as claimed in claim 1, wherein the sliding ring is made of cupric or iron tube.

* * * * *